United States Patent [19]

Pusic et al.

[11] Patent Number: 4,938,192

[45] Date of Patent: Jul. 3, 1990

[54] PISTON CYLINDER COMBINATION WITH ENGINE CYLINDER WALL HAVING VALVE PORTS AND COMBUSTION CHAMBER

[76] Inventors: Pavo Pusic, Moluntska 6; Bozo Memed, B. Mekisica 3, both of Dubrovnik, Yugoslavia, 50000

[21] Appl. No.: 346,075

[22] Filed: May 2, 1989

[51] Int. Cl.[5] ..... F02B 15/00

[52] U.S. Cl. ..... 123/432; 123/433; 123/78 E; 123/197 AC

[58] Field of Search ..... 123/432, 433, 78 E, 123/197 AC

[56] References Cited

U.S. PATENT DOCUMENTS

| | | | |
|---|---|---|---|
| 1,560,492 | 11/1925 | Powell | 123/78 E |
| 1,629,327 | 5/1927 | Waldo | 123/433 |
| 1,892,124 | 12/1932 | Abell | 123/433 |
| 1,907,470 | 5/1933 | Abell | 123/433 |
| 2,678,640 | 5/1954 | Scirocco | 123/433 |
| 2,807,250 | 9/1957 | Mallory | 123/433 |
| 4,084,556 | 4/1978 | Villella | 123/433 |
| 4,124,002 | 11/1978 | Crise | 123/78 E |
| 4,177,772 | 12/1979 | Franke | 123/433 |
| 4,282,845 | 8/1981 | Nohira | 123/433 |
| 4,319,546 | 4/1982 | Beden | 123/197 AC |

FOREIGN PATENT DOCUMENTS

| | | | |
|---|---|---|---|
| 586119 | 10/1933 | Fed. Rep. of Germany | 123/433 |
| 890143 | 7/1949 | Fed. Rep. of Germany | 123/433 |
| 2644875 | 4/1978 | Fed. Rep. of Germany | 123/433 |
| 2745381 | 4/1979 | Fed. Rep. of Germany | 123/433 |
| 615624 | 5/1926 | France | 123/433 |

*Primary Examiner*—E. Rollins Cross

*Attorney, Agent, or Firm*—Kenyon & Kenyon

[57] ABSTRACT

A cylinder bore for an internal-combustion or the like engine, having additional valve ports and an additional combustion chamber machined inside the cylinder wall, is disclosed. Said cylinder bore enables excellent volumetric efficiency and a two-step combustion process which comprises burning of two air-fuel mixtures having different compression ratios and different air-fuel ratios. Increased air provided for the combustion process and better distribution of combustion pressure will result with much more power delivered by engine and less emissions released into the atmosphere.

15 Claims, 5 Drawing Sheets

Fig. 3.
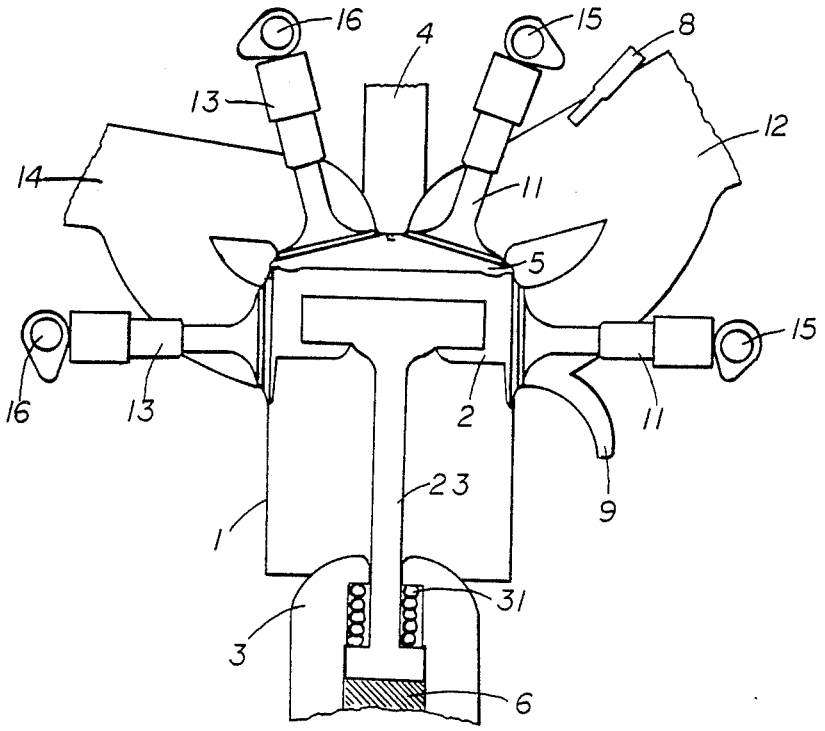
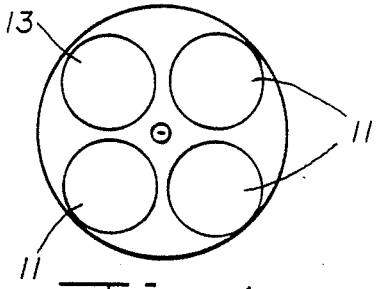
Fig. 4.
Fig. 5.
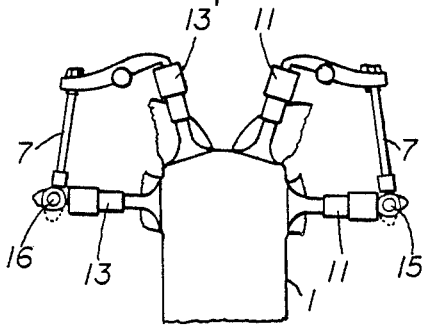

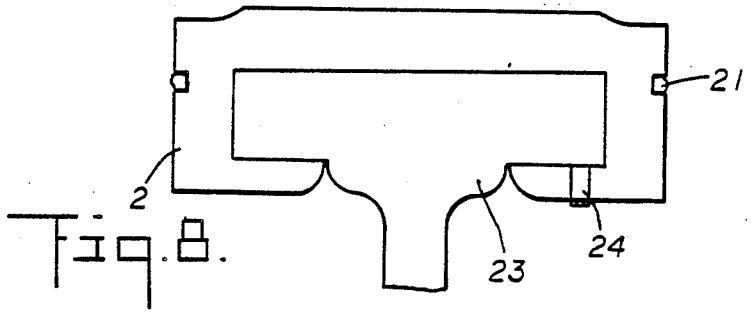
Fig. 8.
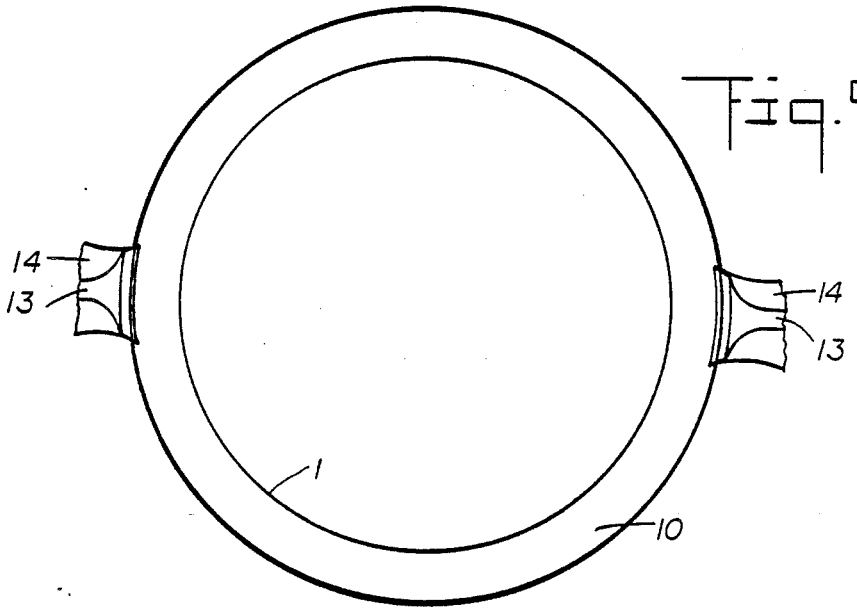
Fig. 9.
Fig. 10.
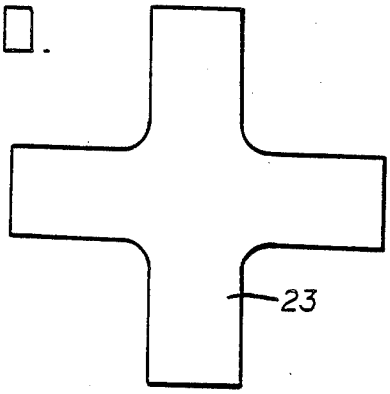

PISTON CYLINDER COMBINATION WITH ENGINE CYLINDER WALL HAVING VALVE PORTS AND COMBUSTION CHAMBER

BACKGROUND OF THE INVENTION

An internal-combustion engine's cylinder bore is a large hole machined inside an engine block, in order to guide the engine piston as it performs its reciprocating motion. In cooperation with the cylinder head, the cylinder bore enables the performance of intake, compression, power and exhaust strokes by the engine piston. The cylinder bore known in the prior art is most commonly machined through the top of the engine block and is slightly larger than the piston to provide a clearance between the two. This clearance allows the piston to move freely in the cylinder. Piston rings are provided to seal the clearance between the cylinder wall and the piston. Since the piston's reciprocating motion inside the cylinder causes a great deal of friction between the cylinder wall and piston rings, the cylinder bore in the prior art is machined with a completely smooth surface. Said friction is caused by forces which act along the engine's connecting rod due to the change of its angle while converting the reciprocating motion of the piston into the rotary motion of the crankshaft. This motion produces side thrust on the piston, thus causing it to shift toward a major thrust face (i.e., the piston presses against a portion of the cylinder wall).

Therefore, the piston rings create taper wear on the cylinder wall. The side thrust does not allow any opening to be machined on any thrust face of the cylinder wall, except in the case of two-stroke engines, wherein intake and exhaust ports are machined in the bottom of the cylinder wall's stroke section.

As proposed in the invention entitled "Hydraulic connecting rod" by the same authors, disclosed to U.S. Patent Office on Apr. 5th, 1989, Ser. No. 07/333,685, the hydraulic connecting rod allows transmission of combustion force without producing any side thrust on the engine piston and, consequently, allows the engine piston to perform its reciprocating motion without causing friction between its rings and the cylinder wall. Therefore, the engine piston can be machined accurately enough to maintain a good seal with the cylinder wall and to prevent excessive "blow-by" of unburned air-fuel mixture and burned gases from the combustion chamber. Since the engine piston slides up and down inside the cylinder wall without any side thrust, the openings can be machined inside the cylinder wall without risking any damage, either of said wall or said piston and its rings. Therefore, additional valve ports and an additional combustion chamber can be machined inside the cylinder wall, in order to obtain excellent volumetric efficiency and allow a two-step combustion process which will result in significantly increased force produced by the cylinder's combustion pressure and better burning of the compressed air-fuel mixture.

There are numerous methods disclosed in the prior art for enhancing the burning of the air-fuel mixture and reducing emissions produced during the engine's combustion cycle. Since the formation of emissions significantly depends on the air-fuel ratio and compression ratio, some of the methods known in the prior art such as the so-called Honda system, comprise a two-step combustion process wherein air-fuel mixtures burned inside precombustion and combustion chambers have different air-fuel ratios. This ensures good burning of the fuel, so that polluting gases are kept to a low level, but does not have a positive effect on the force produced by combustion pressure. Combustion processes in the prior art provide high combustion pressure which significantly drops after about 30 degrees past engine piston's top dead center (TDC), wherein inertia and centrifugal loads strongly influence the combustion pressure's resultant force.

According to the process of the present invention, an additional combustion chamber machined inside the cylinder wall ensures good burning of the fuel and produces additional combustion pressure during that portion of the piston's power stroke, wherein the resultant load significantly decreases due to sudden drop of the combustion pressure.

SUMMARY OF THE INvENTION

It is an object of the present invention to provide an internal combustion engine cylinder bore wherein additional valve ports are machined inside said cylinder bore. Said valve ports will enable improved flow of air and gases into and out of the cylinder and, in conjunction with the valve ports machined in the cylinder head, will enable excellent volumetric efficiency during piston's intake stroke. Fourstroke internal-combustion engines known in the prior art have valve ports machined inside their cylinder heads and, therefore, the area of these ports is limited to the area of said cylinder head. Unless charged, the intake and exhaust valves inside said head do not provide sufficient "breathing" and the cyliner is never quite "filled up".

According to the process of the present invention, additional valves allow the engine to "breathe" better and produce excellent volumetric efficiency, regardless whether a charging system is used. Consequently, the improved combustion process results in improved overall engine efficiency and lower atmospheric emissions.

It is the second object of the present invention to provide an engine cylinder bore, wherein additional valve ports and an additional combustion chamber are machined inside said cylinder bore. According to the process of the present invention, the valve ports machined inside the cylinder wall enable excellent cylinder breathing and the combustion chamber machined inside the cylinder wall allows a two-step combustion process resulting in increased power output and improved air-fuel mixture burning. Since the present invention provides two combustion chambers (one as the prior art and one inside the cylinder wall) with two different compression ratios and two different air-fuel ratios, it will enable an improved two-step combustion process. In order to obtain improved burning of an air-fuel mixture and increase the resultant load of combustion pressure, it is the proposal of the present invention to design such cylinder bore and engine piston structure which will enable said combustion process to start inside the main combustion chamber, which is located inside the cylinder head and refers to a hemispheric, four-valve combustion chamber in the prior art. The richer air-fuel mixture, having a higher compression ratio, is ignited inside said chamber and the combustion pressure forces act on the engine piston as in the process of the prior art. As the piston moves downward it enables ignition of a leaner air-fuel mixture which is compressed inside the additional combustion chamber at a lower compression ratio.

According to the process of the present invention, the combustion which occurs inside the main combustion chamber applies pressure on engine piston as in the process of the prior art and the additional combustion pressure prevents a sudden pressure drop by applying additional pressure on the engine piston. The better distribution of combustion pressure and resultant force increase causes the piston to travel With less vibration, resulting in less heavy shock loads on crankshaft journal's (throw's) bearing and in more power output per cylinder. Reqarding the burning of air-fuel mixtures for the process of the present invention, the combination of burning two different air-fuel mixtures (first richer and more compressed and then leaner and less compressed) will result in an improved burning process and less emissions released into the atmosphere.

In sum, the present invention enables an increase of total engine power output and reduces vibrations while keeping the emissions at a very low level.

It is to be understood that the process of the present invention is closely related to the process of the hydraulic connecting rod which enables its implementation. It is also to be understood that although the description of the present invention refers to a four-stroke gasoline engine, the present invention can be implemented on any other type of internal-combustion engine, if proven more useful than the processes known in the prior art.

Since an automotive engine as proposed for the present invention will require additional camshafts and hydraulic connecting rods which require more space than classical connecting rods, it may seem that such an engine will not be efficient in terms of volume. However, when measured in terms of power output such an engine will require an even smaller volume for the same amount of delivered power. It will eliminate most of engine friction load and a great deal of centrifugal and inertia loads and enable a wide variety of combinations regarding a length of piston stroke and ratio of hydraulic cylinders. It will also be more fuel efficient, have lower weight, better acceleration and deceleration, and produce less vibrations and emissions.

All features and advantages of the present invention will become apparent from the following brief description of the drawings and the description of the preferred embodiment.

BRIEF DESCRIPTION OF THE DRAWINGS

FIG. 3 is the front cutaway view showing the intake and exhaust manifold and valve configuration, as proposed for "version one" of the invention, wherein an OHC configuration is applied.

FIG. 4 is the bottom view of the cylinder head showing the arrangement of three intake and one exhaust valve as proposed for "version one" and version three" of the present invention.

FIG. 5 is the front cutaway view showing the valves' and Camshafts' arrangement, wherein an OHV (overhead valve) and OHC combination is used to operate intake and exhaust valves.

FIG. 8 is the cutaway view showing the engine piston and the upper part of a smaller hydraulic piston as proposed for "version two" and "version three" of the invention.

FIG. 9 is the top cutaway view showing an additional combustion chamber and its exhaust valves as proposed for "version two" of the invention.

FIG. 10 is the top view showing the four-armed upper part of smaller hydraulic piston (which replaces the piston pin) as proposed for all "versions" of the invention.

DESCRIPTION OF THE PREFERRED EMBODIMENT

As mentioned before, the present invention can be applied in different configurations and perform different processes. Therefore, in this description of the preferred embodiment, the three most important configurations will be separately described as "version one", "version two", and "version three". "Version one" will be described first.

Figure 1:
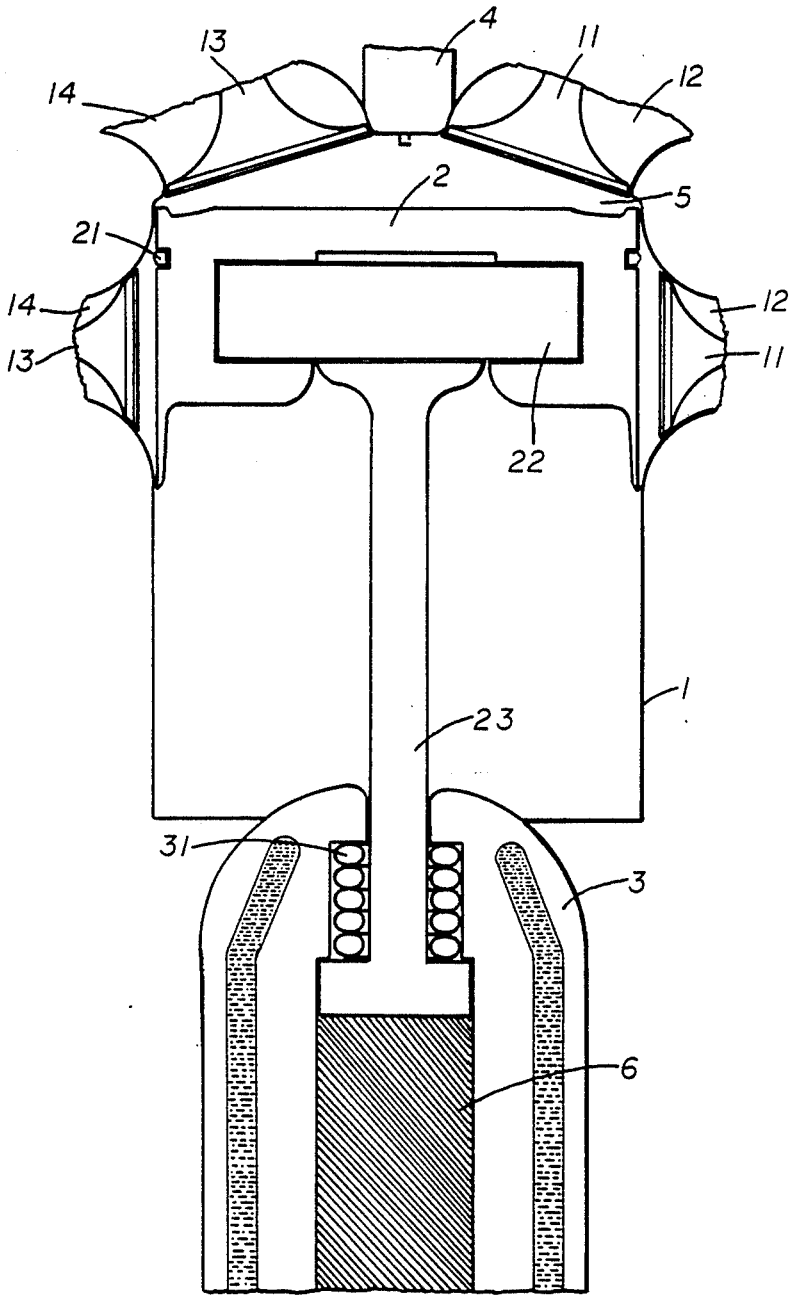
FIG. 1 is the front cutaway view showing cylinder head, cylinder bore, engine piston and upper part of hydraulic connecting rod as proposed for "version one" of the present invention.

Referring to FIG. there is shown a cylinder head comprising intake 11 and exhaust 13 valves, a cylinder bore (wall) 1 comprising one intake 11 and one exhaust 13 valve, an engine piston 2 and the upper part of a hydraulic connecting rod comprising the upper part of a hydraulic rod housing 3, a smaller hydraulic piston 23 and inertia absorbing spring 31. According to the process of the present invention, while performing its reciprocating motion the smaller hydraulic piston 23 slides inside the hole machined in the top of the hydraulic connecting rod housing 3 and inside the smaller hydraulic cylinder 6 without producing any side thrust on the engine piston 2. Therefore, the engine piston 2 slides up and down inside the cylinder wall 1 without any side thrust and does not press unevenly against the cylinder wall 1. This allows the engine piston 2 to be machined to fit the cylinder 1 accurately enough to have minimum clearance and prevent "blow-by" of unburned air-fuel mixture and burned gases. Without any side thrust, the piston 2 will not wear the cylinder wall 1 and the clearance between the two will allow only a thin film of oil to be formed between them. It is also assumed that the combustion process is performed in a manner which does not produce any significant side thrust on the piston 2. In order to decrease the inertia load of the piston 2 and, consequently, enable the spring 31 to absorb all of the inertia loads of the piston 2 and the smaller hydraulic piston 23, one of the lightweight types of piston 2 has to be used. Also the manufacturing method (cast or forged) and material used both for the piston 2 and the cylinder wall 1 must provide a good seal between the two under any engine operating conditions. Elimination of side thrust on the piston 2 will allow use of a lightweight material, such as aluminum, both for the piston 2 and the cylinder wall 1 construction, but any other satisfactory combination known in the prior art can be used, including the combination wherein cylinder block sleeves are provided for the purpose of obtaining a good seal and satisfactory durability of the cylinder wall 1. According to the process of the present invention, it is proposed that at least one piston ring 21 is provided in order to maintain a good seal under conditions which may occur due to possible expansion differences and to perform an oil-scraping process on the cylinder wall 1. It is also proposed that the piston 2, i.e., be provided with a slipper skirt, such as the one shown in FIG. 1, which entirely covers the cylinder valve ports at the piston's TDC in order to prevent too much oil from entering inside said ports and remaining there during the piston's downward motion. Regardless of the fact that, for the purpose of the present invention, piston pin 22 can be machined as in the prior art, as shown in FIG. 1, it is a proposal of the present invention to machine a four-armed piston pin in a cross shape which is an integral part of the smaller hydraulic piston 23, as shown in FIGS. 3, 6, 8 and 10. Since, unlike in the prior art, no rotating motion is performed on the piston pin 22, FIG. 1, it can be machined in said cross shape as shown in FIG. 10, in order to provide sufficient strength when machined in a smaller volume. Consequently, pin holes are not required inside the piston skirt section and four pin bosses are provided wherein the four-armed upper part of the smaller hydraulic piston 23 is inserted and locked by the lock bolt 24, shown in FIG. 8. This enables a ring groove(s) to be machined anywhere on the piston skirt which is (are) significantly shorter than in the prior art. Since transmission of force is performed over four piston bosses, their volume and the volume of each corresponding piston arm can be decreased in order to fit inside the shorter piston 2, without decreasing the total strength of the bosses and piston arms. According to the process of the present invention, regardless of the piston pin type (either the one in the prior art or the proposed four-armed pin) no extensive lubrication of said pin is required and, unless oil is used to cool the piston 2, no oil passages through the piston 2 are necessary. Regarding the piston's 2 and the smaller hydraulic piston's 23 connection, as proposed for the process of the hydraulic connecting rod, it is assumed that they can be machined as one solid part, if proven more suitable for the processes of said inventions. Since the process of the present invention assumes a much shorter engine piston 2 and elimination of the side thrust, the cylinder bore 1 and cylinder block are shortened according to vertical length of the piston 2, as shown in FIGS. 1 and 2.

Figure 2:
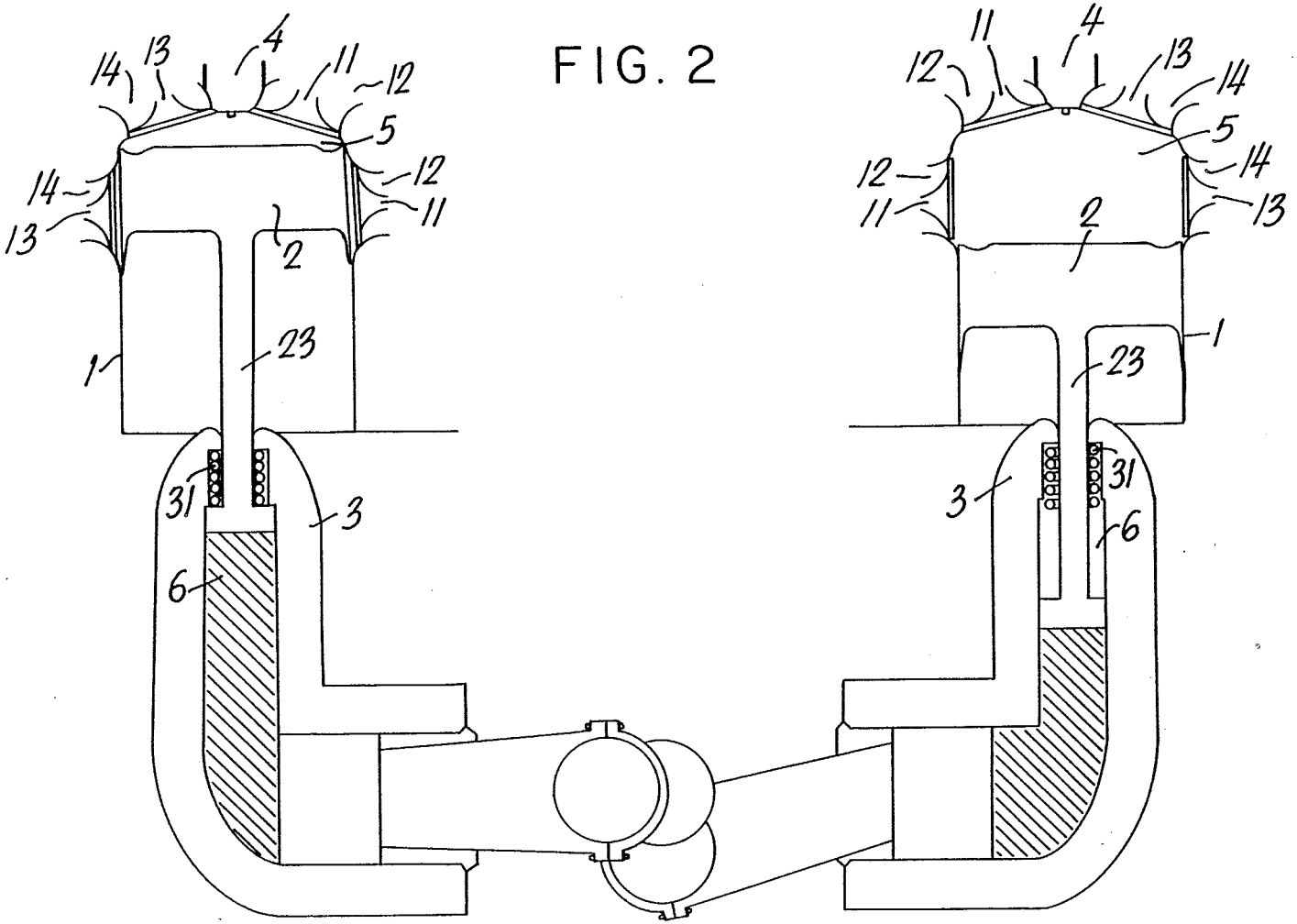
FIG. 2 is the front cutaway view showing two front engine cylinders and corresponding hydraulic connecting rods in a four cylinder engine, wherein half-horizontal connecting rods are applied for the "version one" configuration of the present invention.

Since the present invention (in conjunction with the hydraulic connecting rod) allows the engine piston 2 to perform its reciprocating motion without any side thrust and resulting friction, it is the proposal of the present invention to machine additional valve intake 12 and exhaust 14 ports in the cylinder wall 1, as shown in FIGS. 1, 2 and 3. These additional valve ports 12 and 14 will enable excellent volumetric efficiency under any engine's operating conditions and improve swirl action during piston's intake stroke. According to the process of the present invention, the cylinder wall's intake valve 11 is machined in that side of the cylinder wall 1 wherein intake valves 11 are machined inside the cylinder head, in order to use the same intake manifold 12 as shown on FIG. 3. Said intake valve 11 machined inside the cylinder wall 1 will require an additional camshaft 15 in the case of an overhead cam engine (OHC), and a positive crankcase ventilation system breather opening 9 can be connected into its intake manifold 12, as shown in FIG. 3. The exhaust valve 13 machined inside the opposite side of the cylinder wall 1, shown in FIGS. 1, 2 and 3, uses the same exhaust manifold 14 provided for the cylinder head's exhaust valves 13, as shown in FIG. 3. In case of an OHC engine, said valve 13 will also require an additional camshaft 16, as shown in FIG. 3. The cylinder head for the present invention, shown in FIG. 4, refers to a four-valve cylinder head with overhead cam configuration, as shown in FIG. 3, but it is assumed that for the purpose of the present invention an overhead valve (cam-in-block) configuration can be used as shown in FIG. 5. In this case, there are only two camshafts 15 and 16 provided and they operate the cylinder head valves 11 and 13 by using the push rods 7 to transfer motion to the rocker arms and said valves. The cylinder wall valves and !3 are operated according to OHC principle by the same camshafts 15 and 16, as shown in FIG. 5. According to the process of the present invention, it is proposed that the valves 11 and 13 inside the cylinder head are used as shown on FIG. 4, wherein only one valve is used as exhaust valve 13 and three remaining valves are used as intake valves 1. Said valves are machined as shown on FIG. 4, wherein two intake valves 11 are located on the side of intake manifold 12 and third intake valve 11 is located in the same line with the exhaust valve 13. It is assumed that the process of the camshaft 16 which operates both exhaust valves 13 and one intake valve 11 is adjusted to do this task and that the intake manifold 12 is prolonged enough to reach the third intake valve 11 in the cylinder head. According to the above description, each cylinder is provided with four intake 11 and two exhaust valves 13 which enable excellent "breathing" of the cylinder and allows the engine to reach a very high volumetric efficiency without use of any charging system. According to the process of the present invention, the exhaust valve !3 inside the cylinder head has a larger area than exhaust valves in the prior art, wherein their areas usually do not equal intake valves' areas. Therefore, the two said exhaust valves 13 provided for the process of the present invention will have a larger total area and provide better "breathing" than the two exhaust valves in the prior art. Furthermore, all four valves' ports machined inside the cylinder head have exactly the same area and will allow construction of a better-designed hemispheric combustion chamber with a lower surface/volume (S/V) ratio which produces a lesser amount of unburned HC (hydrocarbon) in the exhaust. For the process of the present invention, it is assumed that the cylinder is supplied with a fuel injector 8, as shown on FIG. 3, but that the present invention is not limited to the fuel injection system. It is also assumed that the present invention can be used in conjunction with any charging system and that the exhaust valve 13 in the cylinder wall 1 can be eliminated if proven not necessary for a certain type of engine. In said case, both exhaust valves 13 will be located inside the cylinder head and operated by an exhaust camshaft 16 and the two intake valves 11 Will be operated by an intake camshaft 15. A third intake valve 11 inside the cylinder wall 1 will be operated either by its own camshaft or together with other intake valves 11 as shown on FIG. 5. It is obviously assumed that the processes of both intake 11 and exhaust valves 13 are arranged according to the piston's reciprocating motion process, in a manner which will allow the most advantageous process of the invention and prevent any possible damage. It is also assumed that, if required for the process when four camshafts are applied, two camshafts which operate intake and exhaust 13 valves inside the cylinder wall 1 can be activated by a switching means which reacts according to different engines' operating conditions.

It is obvious to those skilled in the art that the present invention enables an internal-combustion engine to reach excellent volumetric efficiency and produce less resistance during the piston's exhaust stroke. Therefore, the engine will deliver much more power and keep the emission of pollutants to a very low level, due to its ability to obtain excellent burning of the air-fuel mixture under any engine's operating conditions.

It is to be understood that the present invention can be applied in any type of engine, with any cylinder arrangement including the one shown on FIG. 2, which shows an engine configuration where half-horizontal hydraulic connecting rods are applied on opposed cylinders which have a vertical position.

The following description refers to "version two" of the present invention, which is also enabled by the process of the hydraulic connecting rod which eliminates any side thrust of the engine piston, as described for the "version one" of the invention.

Figure 6:
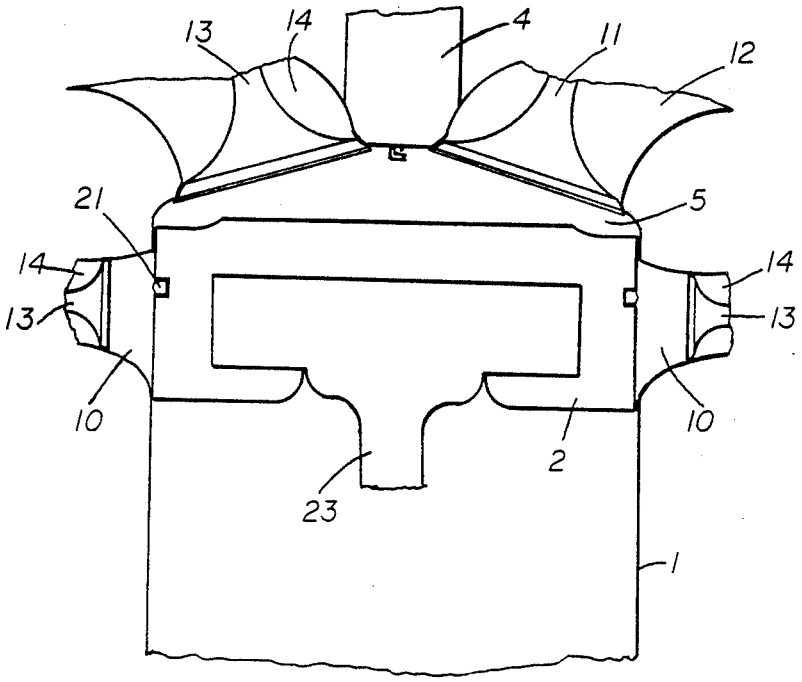
FIG. 6 is the front cutaway view showing cylinder head, cylinder bore and engine piston as proposed for "version two" of the invention.

As shown in FIGS. 6 and 9, in addition to the valves 13 machined in the cylinder wall 1, the "version two" of the present invention provides an additional combustion chamber 10 inside said cylinder wall 1. It is to be mentioned that the design of the piston 2 used in this version slightly differs from the design proposed for "version one", wherein notches in the pistonhead can be provided for adequate valve clearance and the slipper skirt is provided in order to cover valve ports at piston's TDC, as shown on FIGS. 1, 2 and 3. As proposed for the present invention and shown on FIGS. 6 and 9, the piston 2 for this version does not require a slipper skirt design because of smaller valve port areas, and the pistonhead is designed slightly differently for the purpose which will be explained latter in this description. It may also prove necessary that the piston's ring(s) 21 have to be machined with a type of joint which will prevent them from overexpanding when passing through the combustion chamber area, in order to prevent friction which may occur on the combustion chamber's upper or lower edge. The design of the basic piston 2 and the design of the smaller hydraulic piston 23 do not differ from the designs described above for "version one".

As mentioned before and shown in FIGS. 6 and 9, the additional combustion chamber 10 is machined inside the cylinder wall 1. Said combustion chamber 10 is the cavity machined along the cylinder wall which comprises two exhaust valves 13 located on opposite sides of said cylinder wall 1. As proposed for the process of the present invention, the chamber 10 is machined inside the upper part of the cylinder wall 1, wherein its inner surface area will be completely covered by the piston's ring and skirt sections at its TDC. The volume of the additional combustion chamber 10 can be individually determined according to the requirements which will result in the most positive effect. The cylinder head for this version of the present invention refers to the one described above for "version one".

Regarding the valves 11 and 13 machined inside the cylinder head, it is the proposal of the present invention that the exhaust valve's 13 area is decreased in order to enable the increase of the three neighboring intake valves' areas. Since both valves 13 machined inside the cylinder wall 1 will serve as the exhaust valves, the area of the exhaust valve 13 inside the cylinder head can be decreased without having any negative effect during the piston's 2 exhaust stroke. Also, as this version of the present invention provides only three intake valves 11, an increase in their area will result in better cylinder "breathing" during the intake stroke.

Regarding the camshafts' processes, it is assumed that previously described configurations are also used, wherein said processes are arranged according to the requirements of the process for "version two" of the present invention. Unlike "version one", both valves machined inside the cylinder wall 1 operate as exhaust valves 13 in order to allow satisfactory outflow of burned gases during the piston's exhaust stroke.

Since the exhaust valve 13, located on the side of the intake manifold 12, will require an additional exhaust outlet, which has to be connected to the main exhaust manifold 14 and, therefore, has to be located above or around the cylinder block, said outlet can be used to heat the air inside the intake manifold 12, if proven useful for the process of the invention.

According to the process of the invention, during the intake stroke, the air-fuel mixture flows inside the cylinder 1 through three intake valves 11 located inside the cylinder head. A very high volumetric efficiency is reached due to the very high capacity of the intake valves and as the piston 2 moves up during the compression stroke, it compresses the air-fuel mixture inside the additional combustion chamber 10 and inside the main combustion chamber 5, which is located inside the head as in the prior art. Careful timing of the fuel injection during the intake stroke provides a leaner air-fuel mixture to be compressed inside the additional combustion chamber 10 and a richer air-fuel mixture to be compressed inside the main combustion chamber 5.

As shown in FIGS. 6 and 8, in order to provide flow of the leaner air-fuel mixture toward the additional combustion chamber 10, increase swirl action during the compression stroke and enable a higher compression ratio in the main combustion chamber without increasing the tendency to knock; the pistonhead has to be machined in a manner which provides the most satisfactory solution reqarding these requirements. Due to the shorter distance from the piston's BDC, the compression ratio of air-fuel mixture compressed inside the additional combustion chamber 10 is lower than the compression ratio of the air-fuel mixture compressed inside the main combustion chamber 5. The piston 2 and the cylinder 1 must be designed to enable the piston's ring and skirt sections to completely cover the additional combustion chamber 10 slightly before the piston 2 reaches maximum spark-advance position, which for the process of the present invention can be smaller than for the process in the prior art, because the process of the present invention assumes a higher compression ratio in the main combustion chamber 5 which will cause said mixture to burn more quickly when ignited. The pressure developed by the burning highly compressed mixture with high air-fuel ratio pushes the piston 2 down toward the additional combustion chamber 10. This initial main combustion develops a major force as in the process of the prior art, and when the pistonhead edge comes under the upper additional combustion chamber's edge, it ignites the air-fuel mixture compressed inside this chamber 10. Since, at this point, the piston 2 is already accelerated by combustion pressure, it will allow the airfuel mixture from the additional combustion chamber to mix with already burning mixture and burn inside the additional combustion chamber 10 and inside the cylinder 1.

If proven more effective, the additional combustion chamber 10 can be provided with an additional spark plug for purposes of igniting said air-fuel mixture. Burning of the additional air-fuel mixture will develop additional pressure at the point where a significant pressure drop in the main combustion occurs. Accordingly, the main combustion process refers to such processes in the prior art and develops major combustion pressure which is then supported by combustion pressure caused by burning additional air-fuel mixture.

The temperature developed during main combustion ensures good burning of leaner and less compressed air-fuel mixture from the additional combustion chamber 10. It is assumed that the compression ratios, the air-fuel ratios, the combustion chambers' volume and the additional combustion chamber location are determined according to the requirements which will provide the most effective combustion process.

Also, the piston stroke has to be adjusted to provide complete burning of the air-fuel mixture under any given conditions. During the exhaust stroke, the exhaust valves 13 inside the cylinder wall 1 and the exhaust valve 13 inside the cylinder head open and burned gases are pushed out of the cylinder 1. As the piston 2 pushes burned gases through the exhaust valves 13 inside the cylinder wall 1, it creates the flow of gases that will draw out that amount of the burned gases which remain inside the additional combustion chamber 10 when the piston head reaches upper edge of said chamber 10. This assumes that the exhaust valves 13 in the cylinder wall remain open until the piston 2 reaches the upper edge of the additional chamber 10 on its way back for intake stroke. If appropriate for the purpose of the present invention, the earlier closing of said exhaust valves 13 will provide some exhaust gas to be recycled in the cylinder in order to reduce the combustion temperature and the formation of NOx, as exhaust gas recirculation systems or valve overlap systems do in the prior art.

It is obvious to those skilled in the art, that the present invention will enable the resultant force of the combustion pressure to significantly increase without increasing the volume of the cylinder bore. It will enable better dispersion of the combustion pressure and, therefore, diminish the loss of said pressure and engine vibrations. Better and more efficient burning of the air-fuel mixture will be obtained due to a very high volumetric efficiency and a two-step combustion process, wherein the combustion process of a richer and more compressed mixture is continued by the burning of a leaner and less compressed mixture. Regarding the power output, fuel economy and emission of pollutants, it is obvious that the present invention provides a process wherein optimal combination of all involved factors is obtainable. Accordingly, the engine will deliver more power per cylinder, will be more fuel efficient and will keep emissions to a very low level.

It is assumed that the cylinder for the present invention is supplied with a fuel injector but not limited to a fuel injection system and that the present invention can also be used in conjunction with any type of charging system.

Figure 7:
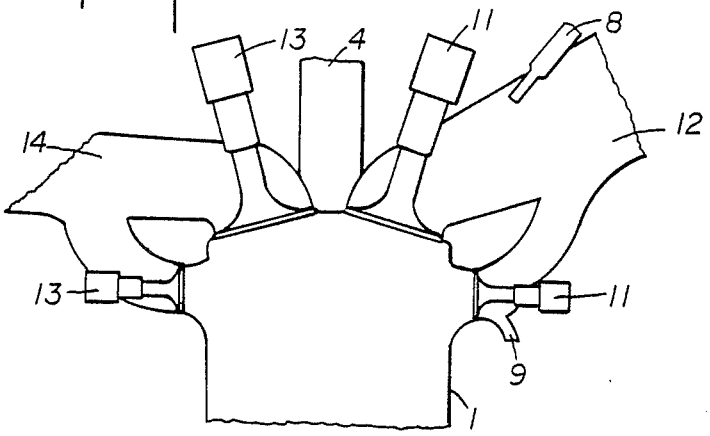
FIG. 7 is the front cutaway view showing the valves' and manifolds' arrangement as proposed for "version three" of the invention.

If appropriate for a certain type of engine, it is possible to apply a process which represents the combination of both described versions, and referred to as "version three" in this description. For "version three", the cylinder bore configuration will refer to the one described for "version two" while the intake-exhaust manifold 12 and 14 configuration and the valves, 11 and 13 arrangement refers to the one described for "version one". Accordingly, as shown in FIG. 7, the valve 11 inside the cylinder wall 1 on the intake manifold 12 side will serve as intake valve and the exhaust valve 13 inside the cylinder head will have the same areas as the three neighboring intake valves 11 as shown in FIG. 4. Consequently, the cylinder will have four intake 11 and two exhaust 13 valves, and a two-step combustion process will be performed as described for "version two". While during the intake stroke more air is drawn into the cylinder 1, during the exhaust stroke more exhaust gases will remain inside the additional combustion chamber 10, because only one exhaust valve 13 is provided inside the cylinder wall 1. Also, the outflow of exhaust gases will create a little more resistance because only two exhaust valves 13 (one inside the cylinder wall and one inside the cylinder head) are provided for this version. In any case, due to the more simple intake-exhaust manifold 12 and 14 configuration and the ability for more air to be drawn inside the cylinder 1, this version can prove very efficient if exhaust gases which remain inside the additional combustion chamber 10 do not create significant problems during the engine's operating conditions, wherein the combustion temperature is low and said additional exhaust gases do not allow a normal combustion process.

As for the two previously described versions, it is assumed that the present invention is applied in conjunction with a fuel injection system but not limited to said system, and that the described process can also be performed in conjunction with any type of charging system. It is also assumed that any previously proposed camshaft configuration can be applied and that the process of said camshafts is adjusted according to requirements of the process of the present invention.

It is to be understood that all three versions of the present invention are not limited to only two additional valves inside the cylinder wall and that the configuration and position of the additional combustion chamber is determined according to requirements, resulting in the most effective process of the present invention.

What is claimed is:

1. A piston cylinder combination for use in a multicylinder internal combustion engine which includes a camshaft, the piston cylinder combination comprising:

a piston having a piston head with a predetermined diameter and cylindrical side wall with a predetermined length;

a cylinder bore comprising a cylindrical wall having first and second ends and a cylinder head at the first end of the cylindrical wall, a plurality of valve ports formed in the cylinder head and at least one valve port formed in the cylindrical wall;

a connecting rod having one end connected to the piston and another end coupled to the cam shaft, the connecting rod being arranged so that the end of the connecting rod which is connected to the piston alternatively guides and is guided by the piston without generating significant side thrust;

wherein the piston is slidably received within the cylinder bore for movement between a top dead center position wherein the piston head is proximate the cylinder head and a bottom dead center position wherein the piston head is proximate the second end of the cylindrical wall; and wherein the valve port formed in the cylindrical wall is formed at a location proximate the cylinder head below the top dead center position of the piston head and above a midpoint position located midway between the top dead center position of the piston head and the bottom dead center position of the piston head.

2. The piston cylinder combination of claim 1 wherein a plurality of valve ports are formed in the cylinder wall, each of a plurality of valve ports being located below the piston head's top dead center position and above the piston head's mid point position.

3. The piston cylinder combination of claim 2 further comprising at least one valve member in each valve port, the opening and closing of each said valve member being controlled as a function of piston position.

4. The piston cylinder combination of claim 1 further comprising a fluid passage connecting the valve port formed in the cylinder wall to one of the valve ports formed in the cylinder head.

5. The piston cylinder combination of claim 2 further comprising a plurality of fluid passages each fluid passage connecting at least one of the valve ports formed in the cylinder wall with one of the valve ports formed in the cylinder head.

6. The piston cylinder combination of claim 1, wherein the length of the cylinder side wall of the piston is less than three-fifths of the piston head diameter.

7. The piston cylinder combination of claim 1 further comprising an annular groove formed in the cylinder wall to define a combustion chamber, the annular groove being located proximate the first end of the cylinder wall such that the groove is covered by the piston side wall when the piston is at the top dead center position but completely uncovered when the piston is at the bottom dead center position.

8. The piston cylinder combination of claim 1 further comprising a non-cylindrical opening formed in the piston opposite the piston head and a piston pin nonrotatably connected to the piston, the piston pin having a first end having a shape which is complementary to the opening formed in the piston.

9. The piston cylinder combination of claim 8 wherein the piston pin is part of the hydraulic connecting rod and the second end of the piston pin comprising a piston portion of said hydraulic connecting rod.

10. A piston cylinder combination for use in a multicylinder internal combustion engine comprising:

a piston having a piston head with a predetermined diameter and a cylindrical side wall with a predetermined length;

a cylinder bore having first and second ends, the cylinder bore comprising a cylinder head at the first end of the cylinder bore, a first combustion chamber bounded in part by the cylinder head, a cylindrical wall extending from the cylinder head to the second end of the cylinder bore and a second combustion chamber formed in the cylindrical wall;

wherein the piston is slidably received within the cylinder bore and slidable with substantially no side thrust between a top dead center position wherein the piston head is proximate the cylinder head and a bottom dead center position wherein the piston head is proximate the second end of the cylindrical wall; and wherein the second combustion chamber is formed at a location proximate the cylinder head below a maximum spark advance position and above a midpoint position located midway between the top dead center position and the bottom dead center position.

11. The piston cylinder combination of claim 10 further comprising a non-cylindrical opening formed in the piston opposite the piston head and a piston pin nonrotatably connected to the piston, the piston pin having a first end having a shape which is complementary to the opening formed in the piston.

12. The piston cylinder combination of claim 10 wherein the piston pin is part of a hydraulic connecting rod and the second end of the piston pin comprising a piston portion of said hydraulic connecting rod.

13. The piston cylinder combination of claim 10 further comprising at least one valve port formed inside the second combustion chamber.

14. The piston cylinder combination of claim 13 further comprising a fluid passage connecting each valve port formed in side the second combination chamber with valve ports formed in the cylinder head.

15. The piston cylinder combination of claim 10 wherein the length of the piston cylindrical side wall is sufficient to completely cover the second combustion chamber when the piston is at top dead center but is less than three-fifths of the piston head diameter.

* * * * *